United States Patent [19]

Williams

[11] Patent Number: 4,829,641

[45] Date of Patent: May 16, 1989

[54] ENHANCED COLOR CHANGE INTERLOCKING CLOSURE STRIP

[75] Inventor: John W. Williams, Oak Lawn, Ill.

[73] Assignee: First Brands Corporation, Danbury, Conn.

[21] Appl. No.: 64,959

[22] Filed: Jun. 22, 1987

[51] Int. Cl.[4] ..... B65D 77/10

[52] U.S. Cl. ..... 24/587; 24/399; 24/576; 383/63

[58] Field of Search ..... 24/587, 588, 576, 399; 383/63; 40/622; 264/12, 15

[56] References Cited

U.S. PATENT DOCUMENTS

| | | | |
|---|---|---|---|
| 3,654,049 | 4/1972 | Ausnit | 383/63 |
| 4,186,786 | 2/1980 | Kirkpatrick | 383/63 |
| 4,212,337 | 7/1980 | Kamp | 24/399 |
| 4,285,105 | 8/1981 | Kirkpatrick | 383/63 |
| 4,295,919 | 10/1981 | Sutrina et al. | 383/63 |
| 4,372,014 | 2/1983 | Simpson | 24/576 |
| 4,561,108 | 12/1985 | Kamp | 24/399 |
| 4,578,813 | 3/1986 | Ausnit | 383/63 |

FOREIGN PATENT DOCUMENTS

| | | | |
|---|---|---|---|
| 0442130 | 1/1968 | Switzerland | 383/63 |

*Primary Examiner*—Victor N. Sakran
*Attorney, Agent, or Firm*—Gary L. Wamer

[57] ABSTRACT

An interlocking closure device including two closure elements arranged to be interlocked over a predetermined length, each of said closure elements having different colors for establishing visually the completeness of the occlusion of the closure elements by providing color different from the closure elements when said closure elements are occluded, wherein the improvement comprises the introduction of a color change enhancement member in the internal channel of a translucent closure element whereby the closing and opening of the closure device is more easily detected by visual inspection.

35 Claims, 12 Drawing Sheets

FIG. 1
(PRIOR ART)
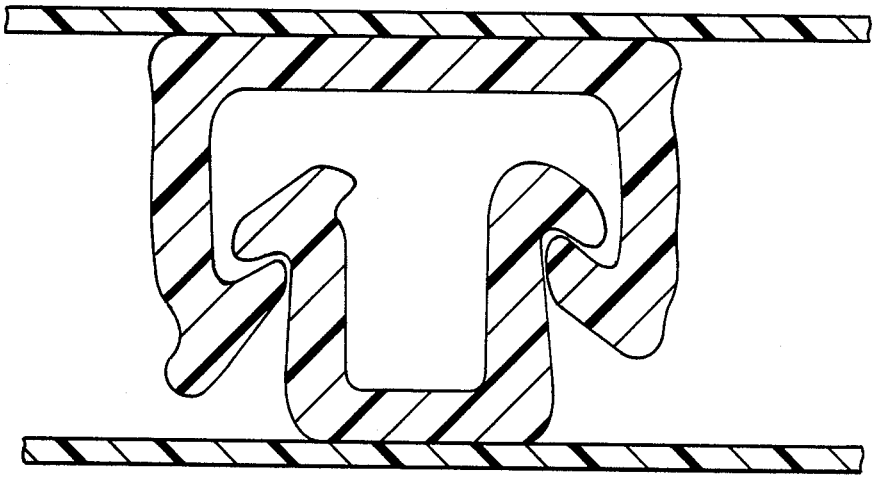
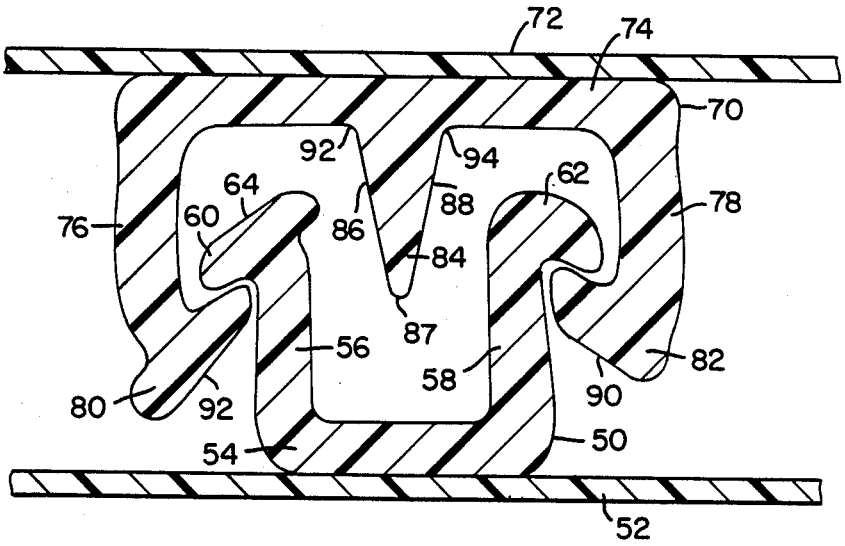
FIG. 5

FIG. 6
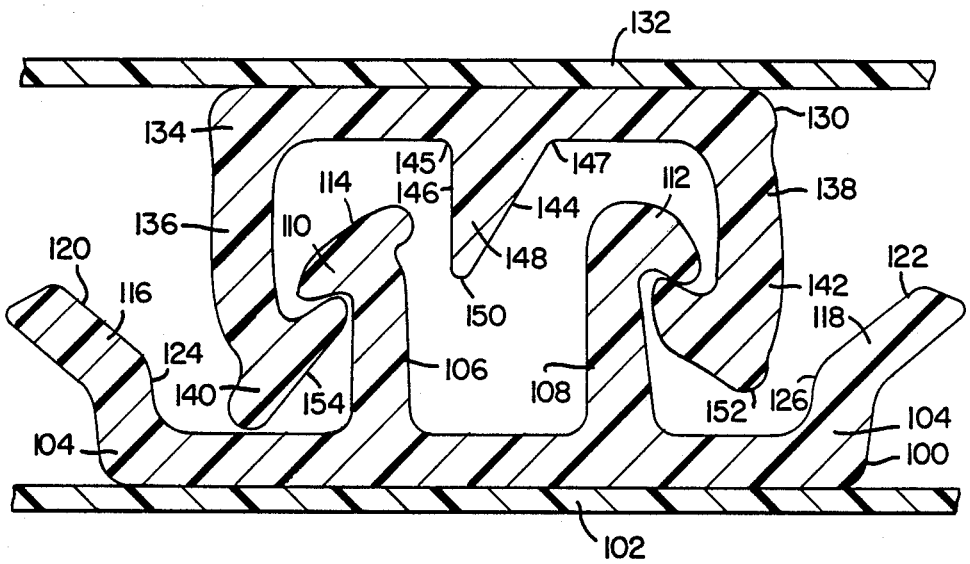
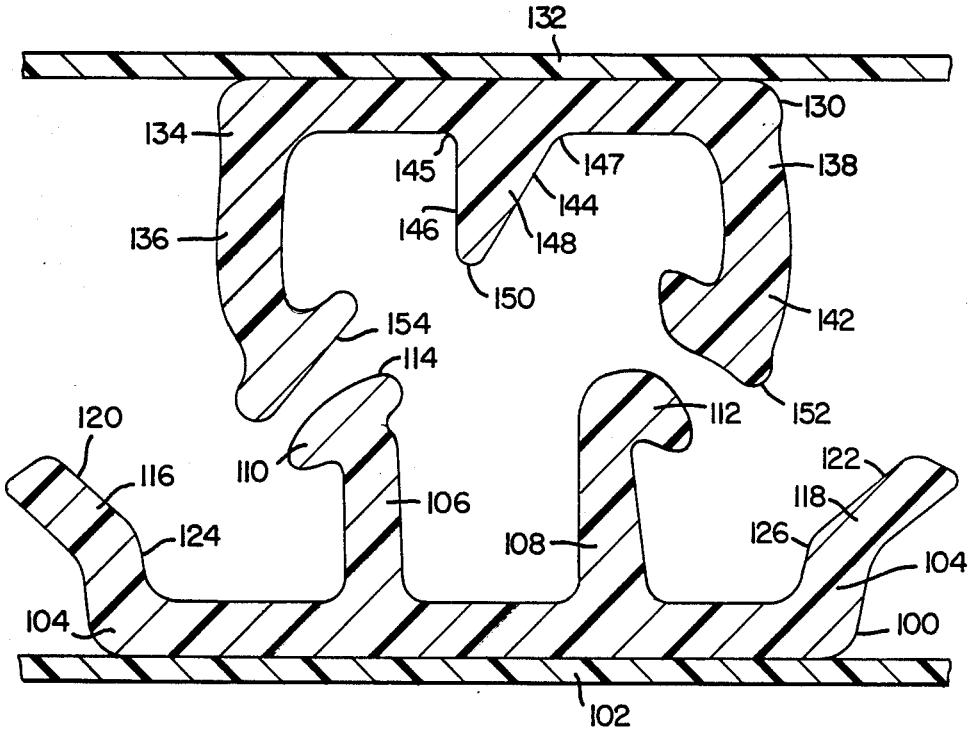
FIG. 7

ENHANCED COLOR CHANGE INTERLOCKING CLOSURE STRIP

FIELD OF THE INVENTION

The instant invention relates to interlocking colored closure strips having improved color change characteristics when viewed in their occluded form. These interlocking colored closure strips may be employed as fasteners in traditional fastener areas and find particular use as closures for storage containers, e.g., plastic bags.

BACKGROUND OF THE INVENTION

The use of closure fastening devices for the closure of containers, including plastic bag bodies, is generally known. Furthermore, the manufacture of closure fastening devices made of plastic materials is generally known to those skilled in the art relating to closure fastening devices as demonstrated by the numerous patents in this area.

A particularly well-known use for closure fastening devices is in connection with a flexible container, e.g., bag bodies. The closure fastening device and the associated container may be formed from thermoplastic materials, and the closure fastening device and sidewalls of the container can be integrally formed by extrusion as a single piece, or may be formed as separate pieces and then connected by heat sealing or other suitable fastening means.

The closure fastening devices incorporated as closures on bag bodies have been particularly useful in improving the retention of contents in the bag body when the closure is closed. In general, the closure fastening devices on bag bodies have been transparent and the bag body has been made of transparent plastic, thus having the same general appearance for the closure and the bag body. The use of the same transparent plastic for the bag body and the male closure and female closure that form the closure fastening device made it difficult to actually determine when the male and female closures were occluded, i.e., when the bag was closed. Since misalignment of the relatively narrow male and female (typically 90 mils to 120 mils wide) closures could easily occur, there existed a reasonable likelihood that the bag body was at least partially open.

The aforementioned occlusion problem arises from the inability of the user to have a means for identifying when the male and female closure are occluded to form a seal between the contents of the bag and the environment external to the inside of the bag. A solution to this problem is disclosed in U.S. Pat. No. 4,186,786, U.S. Pat. No. 4,285,105 and Japanese Patent Application No. 51-27719. A color change means for verifying the occlusion of the male and female members of the closure is provided wherein male and female members having different colors are employed and upon occlusion provide a yet different color. For example, the female member of the closure may be opaque yellow and the male member of the closure may be translucent blue. Upon occlusion of the male member and female member a composite color with a green hue results. This use of a color change greatly improves the ability of the user of the interlocking closure device to determine when the male and female members are occluded. Of course, the relative perceivable difference between the colors of the male member, female member and the occluded female/male members is the critical variable that impacts on how well the user of the bag will be able to ascertain when the bag is open or closed.

The change in color that is viewed when dissimilarly colored male and female members are occluded is demonstrated in a commercially available product sold under the trademark GLAD-LOCK (GLAD-LOCK is the registered Trademark of First Brands Corporation, Danbury, Conn.). The female closure is an opaque yellow and the male closure is a translucent blue. When the male member and female member are occluded, the resulting color has a green hue and provides a color change indicating that the bag body is closed along the length of the closure fastening device. As aforementioned, the ability to ascertain whether the closure device is open or closed is related to the ability of the user to view the change in color of the occluded or unoccluded male and female members of the closure fastening device. Accordingly, any improvement in the relative color change between the male member and female member and the occluded male and female members will provide for improved ease in using the closure device and improved closure device's reliability.

FIGS. 1, 2 and 3 show closures devices that have heretofore been employed as closures on bag bodies. The closure shown in FIG. 1 has been employed as a colored interlocking closure in the manner disclosed in U.S. Pat. Nos. 4,186,786 and 4,285,105. In contrast, the closures shown in FIG. 2 and FIG. 3 have not heretofore been associated with colored interlocking closure devices. Instead, the closures of FIG. 2 and FIG. 3 have heretofore been employed as transparent closure devices having substantially the same transparent coloration as the bag body. As hereinbefore discussed, the use of closures having the same color for the male and female closure elements makes it difficult to visually inspect the closure and reliably detect if the closure is open or closed (occluded). This problem may be particularly troublesome for the closure devices shown in FIGS. 2 and 3 because those closures are relatively small, e.g., less than about 250 mils in width, and, therefore, are not easily grasped for reliable closing. The particular problem associated with aligning and closing small closure elements is discussed in European Patent Application No. 83112946.5. As noted in the European Application, the use of additional ribs on either side of the closure elements has been suggested in the prior art to give an improved "feel" to the closure to provide a stiffer "feel" to the closure and aid in alignment of the closure elements. While the aforementioned European Patent Application addresses an improved manufacturing method for forming the disclosed ribs adjacent the closure element, the problem of visually being able to determine when the closure device is open or closed was not addressed.

The objective in closing an interlocking closure device is best met if the device is both easy to handle (handleability) and easily capable of inspection to determine when the closure device is open or closed. The instant invention is advantageous in that the color change in the color change closure is improved and the instant invention ameliorates the problem that arises as a result of the presence of additional ribs or guide members on colored interlocking closure devices by including a color change enhancement member in the internal channel of the male and/or female closure members. The presence of a color change enhancement member in the closure channel formed by differently colored male and female members has not been disclosed heretofore for providing improved color change characteristics to color change closure devices. Heretofore, internal elements, e.g., the spring element shown in FIG. 7 of U.S. Pat. No. 4,212,337 as being present in the channel of the male closure element, have not been disclosed to provide any color change function but have been provided solely for sealing. The instant invention relates in one aspect to improved color changes in color closure devices. In another aspect the invention relates to improved color change in wider color closure fastening devices, since it has been observed that in such wider closures (e.g., up to about 250 mils, i.e., wider male and/or female members, closure elements, that there is a decrease in the discernible non-occluded/occluded color change of the translucent male and/or female members as the closure is made wider. Therefore, the instant invention relates to improved color change perception in new closure devices with wider male add/or female closure elements. These wider closures may also have adjacent guide members integrally located adjacent to the male and/or female elements of the closure fastening device. It has been observed that while such "ribs" or "guide members" improve the "feel" of the closure change between the non-occluded and occluded male and female closure elements.

SUMMARY OF THE INVENTION

The instant invention generally relates to interlocking closure devices including two closure elements arranged to be interlocked over a predetermined length.

Each of these closure elements have different colors and visually establish the completeness of the occlusion of the closure elements by providing a perceivably different color from that of either closure element when the closure elements are occluded. The change in color observed by occlusion of the closure elements is improved by the instant invention by introducing a color change enhancement member in the internal channel of either closure element. Further, it is believed that use of a color change enhancement member in a translucent closure element is particularly beneficial to the perceivable color change when side guide members are provided adjacent the male and/or female closure elements. This is particularly beneficial when the color change enhancement member is associated with a translucent female element and guide members are associated with an opaque male element. It has been observed that these guide members may interfere with the visual determination of the color change of the closure as determined by the color of the non-occluded male and female closure elements when compared to the color of the occluded male and female closure elements.

DESCRIPTION OF THE DRAWINGS

FIG. 1 is a cross-sectional view of a prior art closure device.

FIG. 5 is a cross-sectional view of one embodiment of the closure fastening device in accordance with the invention in an occluded position having a generally spike-shaped (isosceles triangle-shaped) color change enhancement member extending from the base portion of female closure element.

FIG. 6 is a cross-sectional view of another embodiment of the closure fastening device in accordance with the invention in an occluded position having a generally right triangle-shaped color change enhancement member extending from the base portion of the female closure element and having guide members on either side of the male closure element.

FIG. 7 is a cross-sectional view of the closure fastening device shown in FIG. 6 in a non-occluded position having a generally right triangle-shaped color change enhancement member extending from the base portion of the female closure element and having guide members on either side of the male closure element.

DETAILED DESCRIPTION OF THE INVENTION

Figure 2:
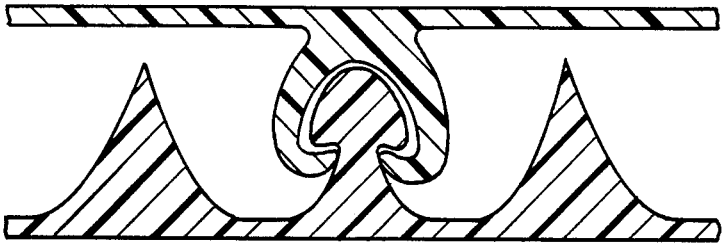
FIG. 2 (PRIOR ART)
FIG. 2 is a cross-sectional view of a prior art closure device.

The instant invention provides interlocking closure devices having improved color change characteristics when viewed in their non-occluded position in comparison to their occluded position. The interlocking closure devices include two closure elements arranged to be interlocked over a predetermined length, each of the closure elements having different colors for establishing visually the completeness of the occlusion of the closure elements by providing a combined color different from the closure elements that are occluded. It has been discovered that the perceivable color change is related to the width of the closure elements, the presence of guide members on the closure element(s) and combinations of these factors. The occluded color change is enhanced, i.e., is more perceivable to the viewer, by introducing a color change enhancement member in the internal channel of a translucent closure element whereby the color change of the closure elements before as compared after occlusion is improved when compared with the color change of a substantially similar closure device but as determined without the color change enhancement member. The terms "male" and "female" closure element are generally understood in the art as closure elements wherein the element that interlocks into the other closure element and having outwardly projecting hooks is referred to as the "male closure element" and the outer element is referred to as the "female closure element" and has inwardly projecting hooks. These terms have been employed to define closure elements without any guide members. The characteristics of this color change enhancement member and its relationship to the male and female closure elements is discussed hereinafter.

The color change enhancement member may be provided to enhance the color change in a wide variety of interlocking closure fastening devices when such are used as color change closures. A "color change closure" comprises a combination of a male closure element of one color, a female closure element of a different color which upon occlusion provide a third and perceivably different color. The interlocking closure fastening device may be as shown in U.S. Pat. No. Re. 28,969, 4,212,337 or as shown in FIG. 5 of U.S. Pat. No. 3,054,434, copending U.S. Ser. No. 774,400, filed Sept. 11, 1985 and U.S. Ser. No. 774,997, filed Sept. 11, 1985 each of the aforementioned items incorporated herein by reference. The interlocking closure fastening devices disclosed in copending U.S. Ser. Nos. 509,388, filed June 30, 1983 and 690,207, filed Jan. 10, 1985, incorporated herein by reference may also be employed in the instant invention as the closure to which the color change enhancement member is introduced when such closure devices are employed as a color change closure device. In addition, guide members may be provided adjacent each of the aforementioned closures of said patents.

The nature of the relationship of the color change enhancement member to the interlocking closure fastening device of which it is an integral part is subject to several variables. These variables include the particular optical properties of the closure elements without a color change enhancement member, the geometry of the color change enhancement member and its light directing properties, the individual and combined optical properties of the aforementioned closure elements and the physical characteristics of the material of construction, e.g., selected plastic, coloration pigments, etc., of the male and female elements of the interlocking closure fastening device. The particular relationship between the color change characteristics of a color change closure is related to the geometry of the color change enhancement member. Such geometrical considerations include the height, width, shape (face angles) and the relative position of the color change enhancement member within the closure element. In addition, the selected geometry of the color change enhancement member is related to the light scattering characteristics of the closure element independent of the color change enhancement member and also when considered in combination with the color change enhancement member. The light scattering characteristics of the closure element are influenced by the depth of the channel of the closure element, the presence of guide members, the width of the closure element and the like. In addition, characteristics of the plastic material of construction, including pigments, $TiO_2$ concentration, and the like may affect the color change characteristics of a color change closure.

The nature of the color selection for a male closure element and/or female closure element has been described in U.S. Pat. No. 4,186,786 at column 3, beginning at line 42 to column 4, line 2, incorporated herein by reference. The selection of the colors of the closure elements as well as the use of translucent or opaque closure elements has heretofore been a matter of selection. In all instances at least one of the closure elements will be translucent and act as the closure element through which the color change is viewed. In one embodiment closure element is opaque as compared to the other closure element with which it interlocks which is translucent. When one of the closure elements is opaque the color change enhancement member will be associated with the translucent closure element.

It has been discovered that while it is beneficial to have a color combination of closure elements wherein one closure element is a translucent blue and the other closure element is opaque yellow it may be preferable to have just the opposite combination, i.e., have a translucent yellow closure element for occlusion with an opaque blue closure element. It is believed that such may be preferred because of the ability of the human eye to preferentially perceive distinctions in various wavelengths of light.

As aforementioned, the actual shape of the color change enhancement member is related to the geometry of the selected interlocking closure device and may be selected to provide for improved perceived color change for a given color change closure. The importance of the correlation of the color change enhancement member to the other characteristics of the closure fastening device is readily apparent when the width of the closure is greater than about 120 mils. These wider color change closure fastening devices may result when guide members are provided on either side (adjacent outside faces of closure legs) of the male element and/or female element or when the closure fastening device is simply made wider. In both the wider closures and when guide members are provided adjacent to the male and/or female closure elements, the optical properties of the closure fastening device adversely affected the light transmitting properties of the closure elements which affect the perceivable color change that is determined between the initially unoccluded closure elements and the occluded male and female closure elements.

Surprisingly, it has been discovered that by providing a color change enhancement member in the channel of either a male or female translucent closure element of a color change closure that the color change characteristics of the closure color change are improved. The improvement in color is particularly beneficial when the width of the closure fastening device is greater than about 120 mils and/or when guide members are provided adjacent the male and/or female closure element. Two different effects are observed as a result of each of these changes in the closure fastening device. As the width of the closure elements increase the larger flat bases of the closure elements act as windows that permit the passage of light into the closure element. This increase in light has a negative effect on the ability to perceive a color distinction between closely placed but non-occluded male and female closure elements and the occluded male and female closure element. The increase in light that enters the wider base of the translucent closure element decreases the perceivable color difference on closely placed yet non-occluded closure elements by permitting viewing of the combined color of the opaque closure element and the translucent closure element prior to occlusion. This gives a viewer a false indication of occlusion, since a color change may be observed when the closure elements are aligned and occlusion has not yet occurred. In contrast, the presence of guide members on a closure element are believed to interfere with light that would enter the closure element and, in fact, therefore do not improve the color change characteristics of a color change closure.

Figure 8:
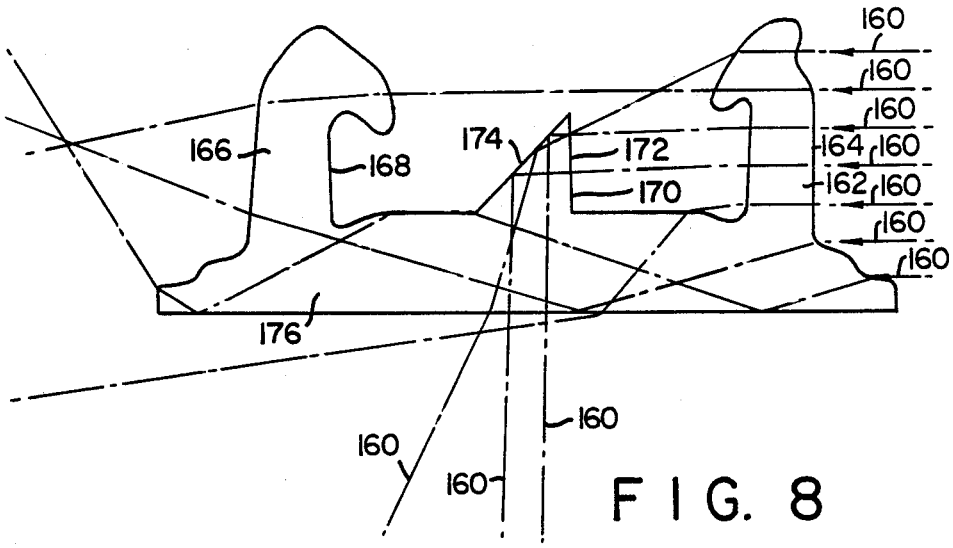
FIG. 8 is a computer simulated light scattering diagram showing the light scattering influence of the color change enhancement member shown in FIG. 7 as a generally right triangle-shaped member.

The improvement in color definition of the closure device is two-fold. The color change between the male and female closure elements is judged by viewing the male and female closure elements in close proximity but non-occluded and then comparing this color with the color viewed upon occlusion of the closure elements. The introduction of a color change enhancement member provides an improvement in the aforementioned perceivable color change. Although not wishing to be limited to any particular theory, it is believed that the color change enhancement member provides several functions. The color change enhancement member improves the individual color characteristics of the translucent closure element of which it is an integral part, which in turn improves the color change distinction of the non-occluded male and female closure elements and the occluded male and female closure elements. The color change enhancement member acts as a light directing member that redirects light entering the sides of the closure element (see: FIG. 8) and directs it to the area viewed by the user of the color change closure in evaluating the change in color of the occluded closure elements as compared to the non-occluded male and female closure elements. This aspect is particularly beneficial when the male and female closure elements are placed in close proximity, since light that could have entered the translucent closure element having the color change enhancement member is now at least partially blocked by the other closure element.

Figure 20:
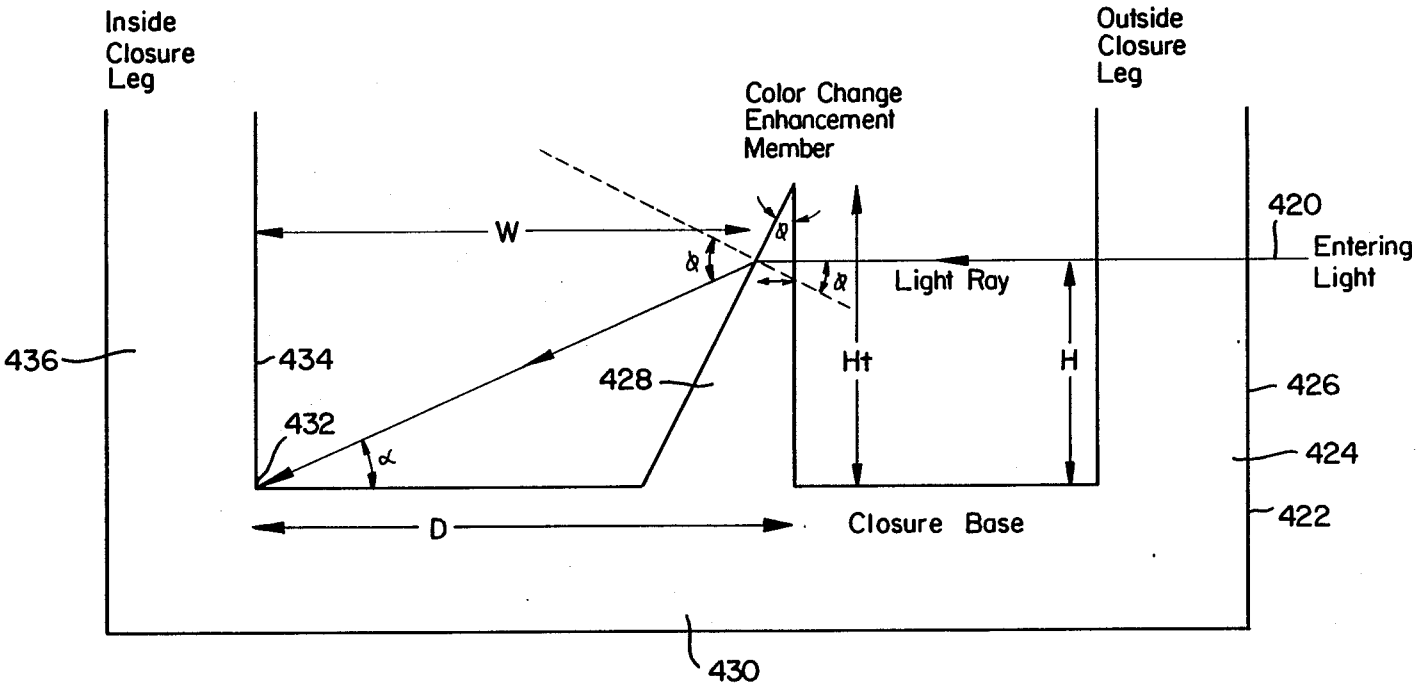
FIG. 20 is a diagram that depicts the physical characteristics of the special relationships of the color change enhancement member in relation to the closure legs and closure base of the closure element.

The shape of the color change enhancement member and its position in relation to the closure element of which it is an integral part is selected to act as a means for improving the observed color difference of the non-occluded male and female closure elements and the occluded male and female closure elements which are a different color than that observed upon occlusion of male and female closure elements. The relationship of the physical characteristics of the closure element with associated color change enhancement member is shown in FIG. 20. Incident light 420 enters closure element 422 through outside leg 424 via outside leg face 426. This incident light is shown in FIG. 20 as perpendicular to the outside leg face. It will be appreciated that without a color change enhancement member that such perpendicular light rays are likely to pass through the legs of the closure element instead of the closure base and that without re-direction to the closure base this light will not be used for illuminating the closure base. The light passes incident to the color change enhancement member where it is directed downward and preferably is directed through closure base 430 at a point within the channel of the closure element. The light is preferably directed within the channel of the closure element before the point where inside leg face 434 of the inside closure leg 436 meets closure base 430 at interface 432. The terms "inside" and "outside" are employed herein to refer to the legs of the closure element where light enters the closure element (outside) for direction by the color change enhancement member and the closure leg towards which this light is directed by the color change enhancement member (inside). It is understood that the designation of either leg of the closure element as "inside" or "outside" is made herein for ease of explanation of the light directing properties of the color change enhancement member. In fact, each leg of the closure element acts as an outside leg since incident light passes through both translucent closure legs.

The correlation of the geometric shape of the color change enhancement member to the desired optical properties of the closure element is characterized in FIG. 20 wherein the direction of a perpendicular light ray through a non-occluded female or male closure is shown to depend on several factors which are correlated by the following relationship:

$$H/\mathrm{Tan}\,(\mathrm{Asin}\,[N\sin\phi]-\phi)+(H_t-H)\mathrm{Tan}(\phi)\leqq D$$

wherein N is the index of refraction of the material that is used to make the closure element; H is the height of the incident light ray above the base of the closure element; $H_t$ is the total height of the color enhancement member as measured from the base of the closure element; $\phi$ (phi) is the angle at the top of the color change enhancement member; and D is the horizontal distance between the light incident first face of the color change enhancement member and the intersection of the inner face of the inner leg and the base portion of the closure element. Referring to FIG. 20, the color change enhancement member is generally shown as having the face upon which light enters the member as generally parallel to the first leg of the closure element. It will be appreciated that in embodiments according to this invention that the incident light surface of the color change enhancement member may be other than generally parallel to the first leg of the closure element and this will result in a reduced light-directing function for the same angle $\phi$ (phi). The correlated relationship of the above factors is such that improvement in the lighting of the closure element results from side light entering through a translucent leg of the closure element. Redirection of this light is achieved when the left hand side of the aforementioned relationship is less than or equal to D and preferably when it is less than D. The actual dimensions of a representative female closure element having a right triangle-shaped color enhancement member is shown in FIG. 4 where the values for the dimensional parameters on FIG. 4 are (given in mils):

| Parameter | Range (mils) | Preferred (mils) |
|---|---|---|
| Z | 50–70 | 55–65 |
| Y | 01–55 | 23–33 |
| X | 06–16 | 9–13 |
| W | 120–140 | 125–135 |
| V | 01–41 | 16–26 |
| U | 62–82 | 67–77 |
| T | 05–105 | 50–60 |
| S | 48–68 | 53–63 |

Figure 4:
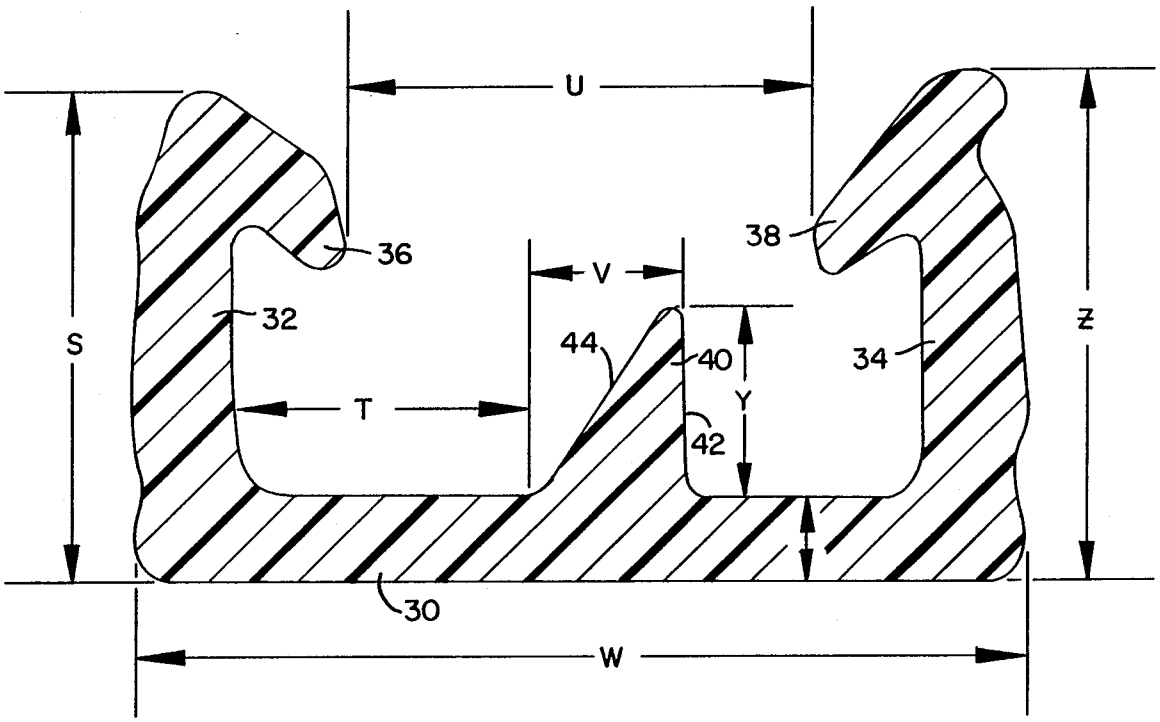
FIG. 4 is a cross-sectional view of one embodiment of a female closure element according to the invention showing the relative dimensions of the various elements of the female closure element.
Figure 21:
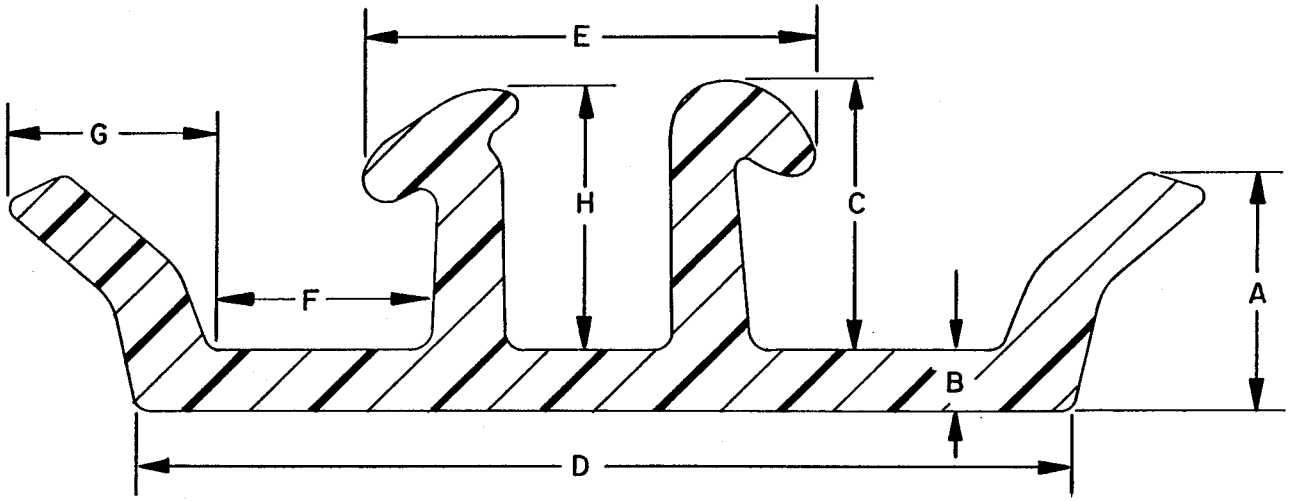
FIG. 21 a cross-sectional view of one embodiment of a male closure element according to the invention suitable for use with the female closure element of FIG. 4 and showing the relative dimensions of the various elements of the male closure element.

A male closure element for use in conjunction with the female closure element of FIG. 4 is shown in FIG. 21 wherein the dimensional parameters are (given in mils):

| Parameter | Range (mils) | Preferred (mils) |
|---|---|---|
| A | 30–50 | 35–45 |
| B | 10–16 | 11–15 |
| C | 28–48 | 33–43 |
| D | 170–190 | 175–185 |
| E | 73–93 | 78–88 |
| F | 10–50 | 25–35 |
| G | 13–23 | 16–20 |
| H | 31–51 | 36–46 |

In a closure fastening device having a color change enhancement member where the quantity H/Tan (Asin $[N(\sin\phi]-\phi)+(H_t-H)\mathrm{Tan}(\phi)$ is less than or equal to D (see FIG. 20) the incident light entering the closure is directed toward the base of the closure element and serves to illuminate the base of the closure element.

Generally, the closure elements of this invention that form the closure fastening devices may be formed from thermoplastic materials such as polyethylene, polypropylene, nylon, or the like, or from a combination thereof. Thus, resins or mixtures of resins such as high density polyethylene, medium density polyethylene and low density polyethylene may be employed to prepare the novel closure device of this invention. The particular coloration of the thermoplastic material may have an advantageous affect on the color change characteristics of the closure, since the light dispersing properties of the colored thermoplastic material are important.

In one embodiment the female and male closure elements are as shown in FIG. 6 and FIG. 7. The closure fastening device shown comprises male and female closure elements wherein the female closure element has an integrally formed color change enhancement member and the male closure element has integrally formed guide members spaced apart from the pair of spaced-apart, parallelly disposed webs that extend generally normal from the base of the closure element. In this embodiment one of the closure elements is an opaque primary color and the other closure element is a sufficiently translucent primary color which upon occlusion provides a third color when viewed through the translucent closure element.

The closure fastening device of the invention may be manufactured by extrusion, or other known methods of producing such devices. The closure fastening device can be manufactured as individual closure elements for later attachment to a film, or the closure element portions can be manufactured integral with a film. In addition, the closure fastening device can be manufactured with or without flange portions on one or both of the closure elements depending upon intended use or expected additional manufacturing operations.

In the practice of the instant invention, the closure fastening device may be integrally formed with the sidewalls of a container, or connected to a container, by the use of any of many known methods. A thermoelectric device can be applied to a film in contact with a flange portion of a closure element or the thermoelectric device can be applied to a film in contact with the base portion of a closure element having no flange portion, to cause a transfer of heat through the film to produce melting at the interface of the film and the flange portion or base portion of the closure element. The bonding of closure element(s) to the film stock may be carried out either before or after the film is U-folded but in any event is done prior to side sealing the bags at the edges by conventional thermal cutting. The thermoelectric device can be heated rotary discs, or resistance heated slide wires, or traveling heater bands, or the like. The connection between the film and the closure element can also be established by the use of hot melt adhesives, or hot jets of air to the interface, or ultrasonic heating, or other known methods. Generally, the closure fastening device and the films that form the body of the bag can be made from a heat sealable material so that a container can be formed economically by heat sealing the aforementioned components to form the container using thermoplastics of the type aforementioned for formation of the closure elements.

In addition, the closure fastening device with the color change enhancement member is more difficult to deocclude from the inside of the containers than from the outside of the containers thereby providing more secure containment of goods such as food products. The element portions of the closure device have approximately uniform cross-sections. This not only simplifies the manufacturing of the device but it also contributes to the physical flexibility of the device, which is a desirable property.

Generally, the closure fastening device of this invention can be manufactured in a variety of forms to suit the intended use. In addition, the male and female closure elements can be positioned on opposite side of a film. Such an embodiment would be suited for enwrapping an object or a collection or objects such as wires. Generally, the male and female closure elements on a film should be parallel to each other, but this would depend on the intended use.

Figure 3:
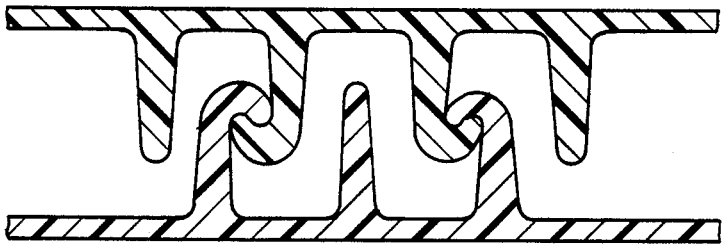
FIG. 3 (PRIOR ART)
FIG. 3 is a cross-sectional view of a prior art closure device.

FIGS. 1, 2 and 3 are prior art closures. The closure of FIG. 1 has been employed as a closure in accordance with the disclosure of the U.S. Pat. No. 4,186,786 as a colored interlocking closure strip having a width at its base less than 120 mils. The closures shown in FIG. 2 and FIG. 3 are prior art closures which have not heretofore been associated with color change closure strips.

FIG. 4 is a female closure element according to the instant invention having a base portion 30, a pair of spaced-apart parallelly disposed webs 32 and 34 extending in a generally normal direction from base portion 30 and having female hook portions 36 and 3 extending from webs 32 and 34, respectively, and facing towards each other with color change enhancement member 40 having a generally right triangle-shaped form with light generally perpendicular to face 42 and with hypotenuse face 44. The dimensional parameters Z, Y, W, X, W, V, U, T and S have been heretofore defined.

Figure 19:
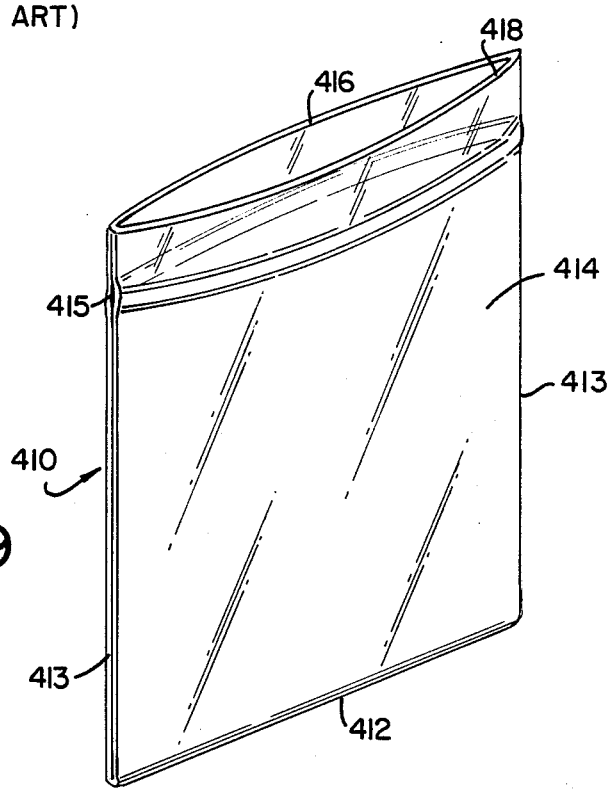
FIG. 19 is a perspective view of a flexible container including a closure fastening device in accordance with the invention.

FIG. 5 shows an embodiment wherein a male element portion 50 is connected to a flange portion 50 and includes a base portion 54, a pair of spaced-apart, parallelly disposed first webs 56 and 58 extending in a generally normal direction from the base portion 54, and male hook portions 60 and 62 extending from webs 56 and 58, respectively and facing away from each other. One of the male hook portions has an inwardly projecting guide surface 64, which generally serves to guide the hook portions for occlusion with the female hook portions of a mating closure element. A female element portion 70 is connected to flange portion 72 and includes a base portion 74, a pair of spaced-apart, parallelly disposed webs 76 and 78 extending in a generally normal direction from base portion 74 and female hook portions 80 and 82 extending from webs 76 and 78, respectively, and facing towards each other and color change enhancement member 84 as a generally spiked-shaped member having opposing faces 86 and 88 characterized as having substantially the same length, as measured from midpoint 87 of member 84 to the base portion where member 84 abuts base portion 74. One of the female hook portions has a rounded crown surface 90, the other has an inwardly projecting guide surface 92 which serves to guide the hook portions for occlusion with the male hook portions of a mating closure element. Closure elements 50 and 70, shown in FIG. 5, may be separately formed and therefore connected to a firm which forms sidewalls of a bag body, or they may be integrally formed with such sidewalls (as shown in FIG. 19). The color change enhancement member 84 shown in FIG. 5 is an isosceles triangle-shaped member having first side portion 86, second side portion 88, where first and second base side portions contact closure base 74 at 92 and 94.

Guide members may be added to provide improved "feel" to the closure device and may be provided in the shape of triangles, rectangles or other suitable shapes and are generally provided by extrusion as an integral part of the male and/or female closure elements. Further, the guide members may be provided as outer aligning members that guide the male and female closure elements towards each other. In one embodiment the guide members extend from the flange portion on each side of the male closure element in a generally perpendicular direction at the base with an outwardly bending top member such that a funneling-type direction orientation is provided as the female closure element is brought into contact with the male closure element. FIG. 6 shows such an embodiment.

As shown in FIG. 6, a male portion 100 is connected to a flange portion 102 and includes a base portion 104, a pair of spaced-apart, parallelly disposed first webs 106 and 108 extending in a generally normal direction from the base portion 104, and male hook portions 110 and 112 extending from webs 106 and 108 and facing away from each other. One of the male hook portions has an inwardly projecting guide surface 114 which generally serves to guide the hook portions for occlusion with the female hook portions of a mating closure element. A second pair of spaced-apart, parallelly displaced second webs 116 and 118 are spaced apart on either outward side of the first spaced apart webs and extend in a generally normal direction at portions 124 and 126 from the base portion 104 with generally outwardly projecting guide surfaces 120 and 122, respectively, to provide guide surfaces for the female closure element. A female element portion 130 is connected to flange portion 132 and includes a base portion 134, a pair of spaced-apart, parallelly disposed webs 136 and 138 extending in a generally normal direction from the base portion 134 and female hook portions 140 and 142 extending from webs 136 and 138, respectively, and facing towards each other and color change enhancement member 144 as a generally right triangle-shaped member having a generally parallelly disposed first face 146 extending in a normal direction from the base portion 134, an angularly disposed second face 148 and top 150. One of the female hook portions has a rounded crown surface 152 and the other has an inwardly projecting guide surface 154 which serve to guide the hook portions for occlusion with the male hook portions of a mating closure element. Closure elements 100 and 130 shown in FIG. 6 may be separately formed and thereafter connected to a film which forms sidewalls (not shown) by the flanges 102 and 132 or they may be integrally formed with such sidewalls (not shown). The color change enhancement member 148 shown in FIG. 6 is a generally right triangle-shaped member having substantially first perpendicular side portion 146, non-perpendicular second side portion 144, first and second base contact points 145 and 147 and top 150.

FIG. 7 is similar to FIG. 6 and shows the male and female closure elements of FIG. 6 in a non-occluded position. The relative spatial relationship of the male and female closure elements prior to occlusion shows the funneling or guide function that the guide members provide as the male and female closure elements are occluded.

In FIG. 6 and FIG. 7 the guide members have been introduced adjacent and spaced apart from either side of the legs of the male closure element to provide a wider closure characterized by improved handleability, i.e., the wider closure has improved "feel" and also such guide members provide improved guidance during occlusion. The color change enhancement member is advantageously employed with an opaque translucent female closure element when the guide members are employed with the male closure element, since it is believed that the guide members obstruct light entering the near occluded closure elements, as hereinbefore discussed. The functional and critical nature of the color change enhancement member as part of the translucent closure element is more clearly understood by reference to FIGS. 8 to 14.

Figure 9:
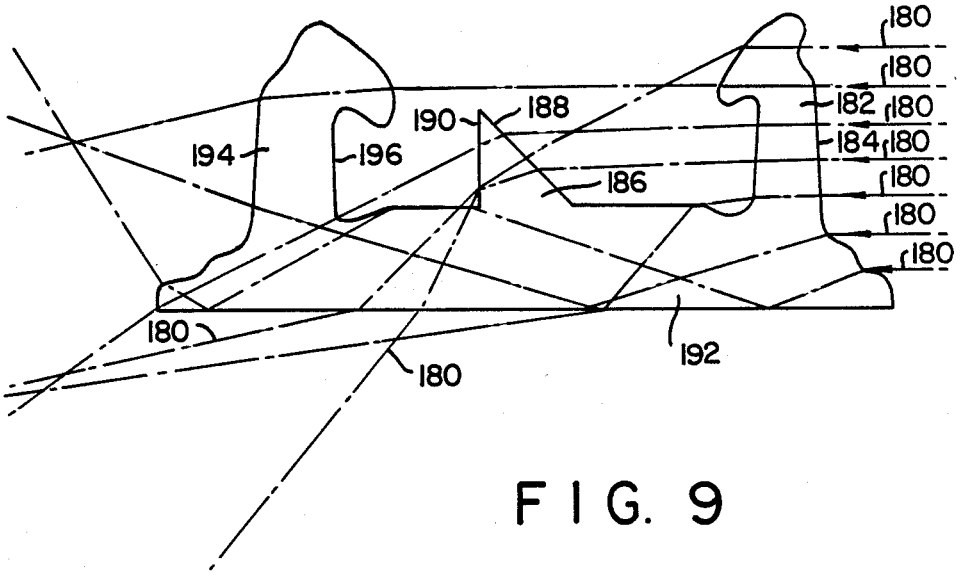
FIG. 9 is a computer simulated light scattering diagram showing the light scattering influence of a color change enhancement member having a generally right triangle-shaped and having the generally perpendicular side of the generally right triangle-shaped color change enhancement member in a configuration that is reversed from that shown in FIG. 8.
Figure 10:
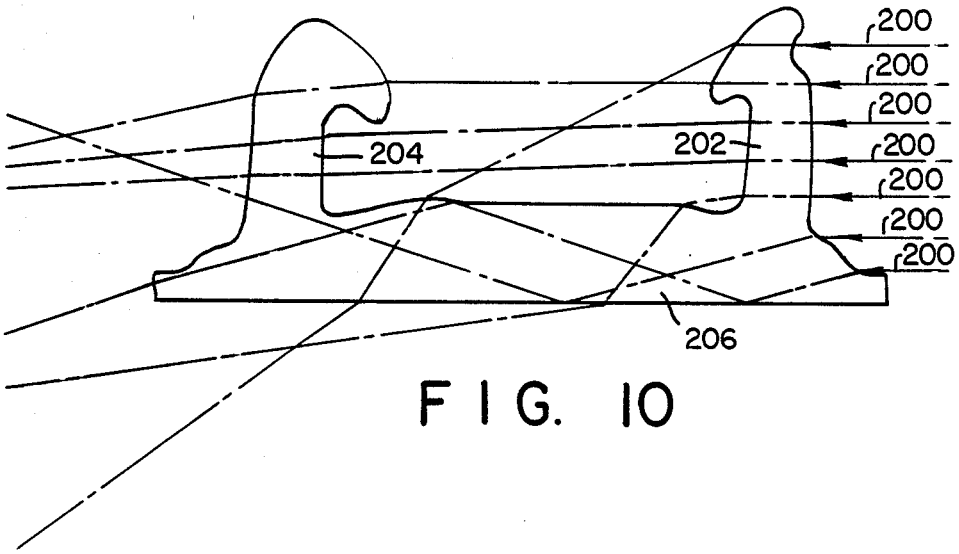
FIG. 10 is a computer simulated light scattering diagram showing the light scattering pattern of the female closure element as shown in FIG. 1.

FIG. 8 is a computer simulated light diagram showing the effect of the color change enhancement member on incident light 160 that enters the side of a translucent female closure element having first leg 162 with outer face 164, second leg 166 with inner face 168, color change enhancement member 170 with light incident face 172, light directing face 174 and base portion 176. Light passing through leg 164 passes incident to the color change enhancement member 170 incident to face 172. The light incident to the color change enhancement member is bent to pass through closure base portion 176 and is preferably bent such that the light passes through the base portion of the closure element before it is incident on the inside surface 168 of leg 166. The direction of incident light 160 in FIG. 8 is based on the assumption that leg 164 will be positioned as the top of the closure device when placed on a bag body. For example, in FIG. 19 leg 164 would be adjacent the top or opening of the bag and would be the portion of the closure element that has incident overhead light. During normal use of such containers the lighting will be supplied by overhead lighting and, accordingly, the incident light will be primarily in a direction generally downward and incident on face 164 of leg 162. It will be understood that incident light may also pass through inside leg 166 and be bent by the color change enhancement member. The reverse orientation of the color change enhancement member of FIG. 8 is shown in FIG. 9 where incident light 180 passes through leg 182 having outer face 184 and is incident on the non-perpendicular face 188 of color change enhancement member 186 and is bent so as to pass through base portion 192 of the female closure element. As discussed above in relation to FIG. 8 the redirection of the incident light through the base portion of the closure element serves to illuminate the color of the translucent closure element and minimizes the reliance on light from the open face of the closure element for illumination. This feature is beneficial when the male and female closure elements are in close proximity and light passing from the open face of the female closure element is obstructed by the male closure element. The illumination benefit provided by the color change enhancement member can be appreciated by reference to FIG. 10 wherein the female closure element is substantially the same as the no color change enhancement member is present. Incident light 200 is perpendicular to translucent leg 202 then passes through leg 202 and then passes uninhibited through leg 204. The light is not directed through base portion 206 of the closure and provides no benefit in illumination of the closure, since light is not directed through base portion 206 of the closure.

Figure 11:
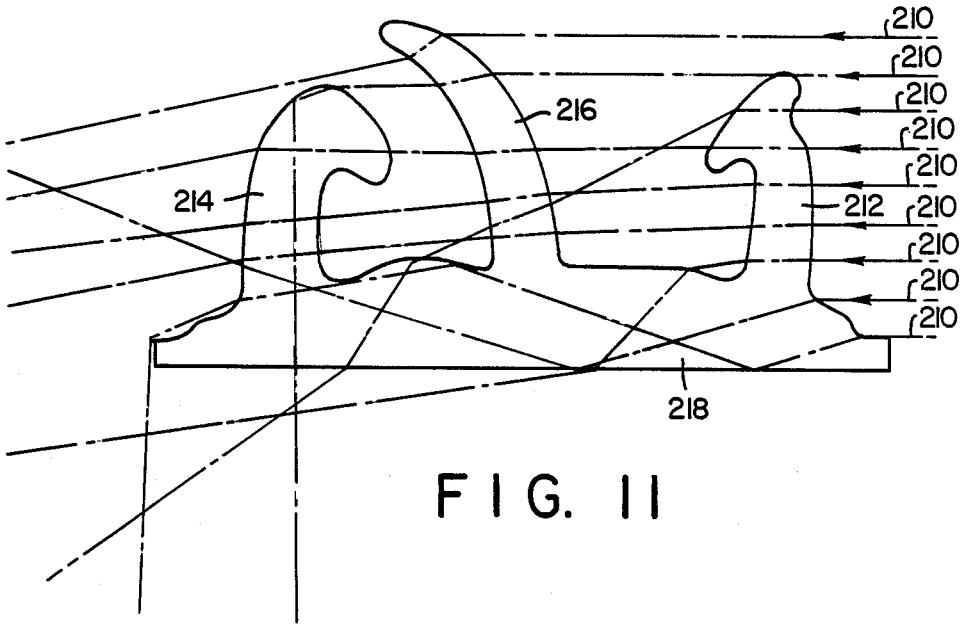
FIG. 11 a computer simulated light scattering diagram showing the light scattering pattern of the male element shown in FIG. 7 of U.S. Pat. No. 4,212,337 having the sealing element shown therein bent away from incoming light.
Figure 12:
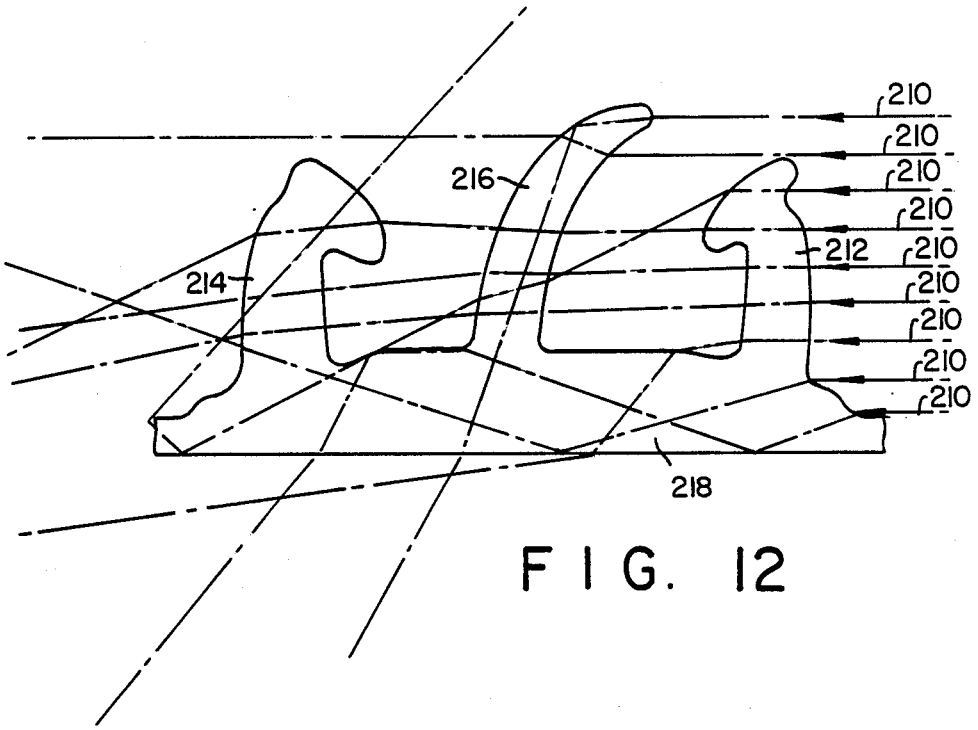
FIG. 12 similar to FIG. 11, except the sealing element towards the incoming light.
Figure 13:
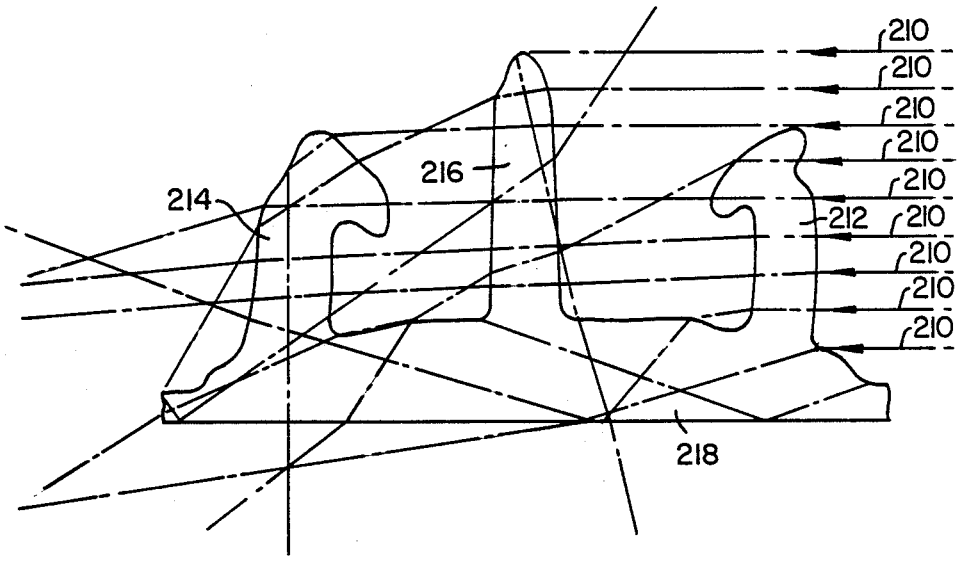
FIG. 13 is similar to FIG. 11, except the sealing element is not bent in relation to the incoming light.

Comparison between FIG. 8 and FIGS. 11, 12 and 13 show the importance of having a color change enhancement member that functions as a light directing member, i.e., directs light to illuminate the base portion of a translucent closure element of which it is an integral part. FIG. 11 shows the effect of a non-light directing element in a male closure element as disclosed in FIG. 7 of U.S. Pat. No. 4,212,337. The center element shown in FIG. 7 of U.S. Pat. No. 4,212,337 is a spring element that is longer than the depth of the channel of the element and is characterized by faces that are generally parallel to the faces of the legs of the closure element. Since the length of the center element 46 in FIG. 7 of the patent is longer than the depth of the channel of the closure element the center element 46 may be either straight, deflected upward or downward as the male and female closure elements are contacted just prior to occlusion. FIGS. 11, 12 and 13 show a downward deflection, upward deflection and no deflection of the center member, respectively.

In each of FIGS. 11, 12 and 13 incident light 210 perpendicular to leg 212 passes through first leg 212, center member 216 and passes from the closure element through leg 214. The center element 216 does not act to direct light through closure base 218.

Figure 14:
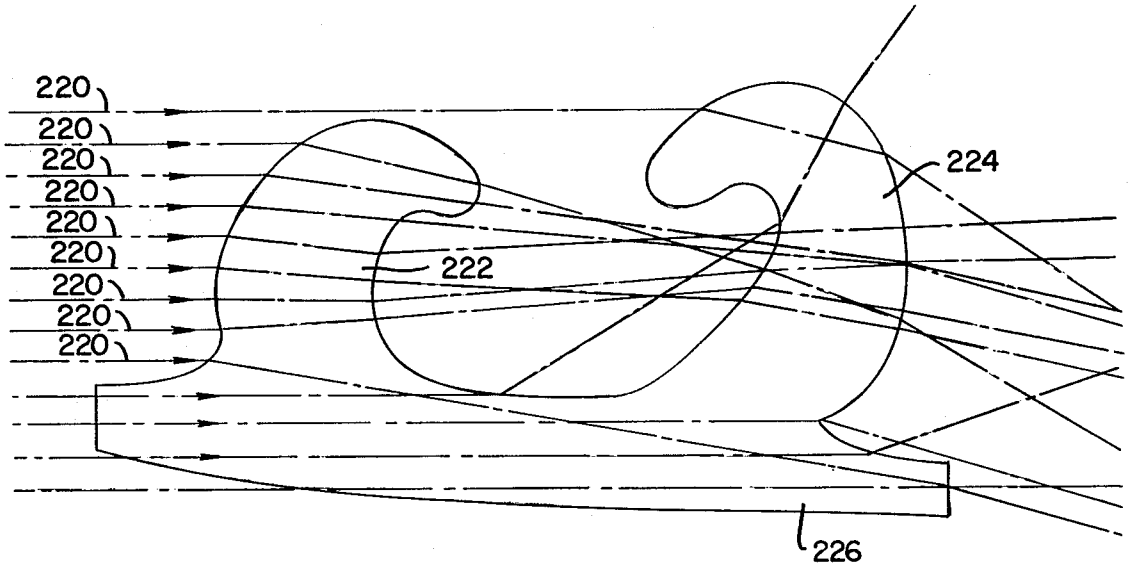
FIG. 14 is a simulated computer light scattering diagram showing the light scattering pattern of the female closure element shown in FIG. 2.

FIG. 14 is a computer simulation of the path that incident light 220 follows as it impinges on leg 222 and leg 224 of the prior art female closure element shown in FIG. 2. As shown in FIG. 14 the legs of the closure element do not direct light to pass through and illuminate base portion 226 of the closure element.

Figure 15:
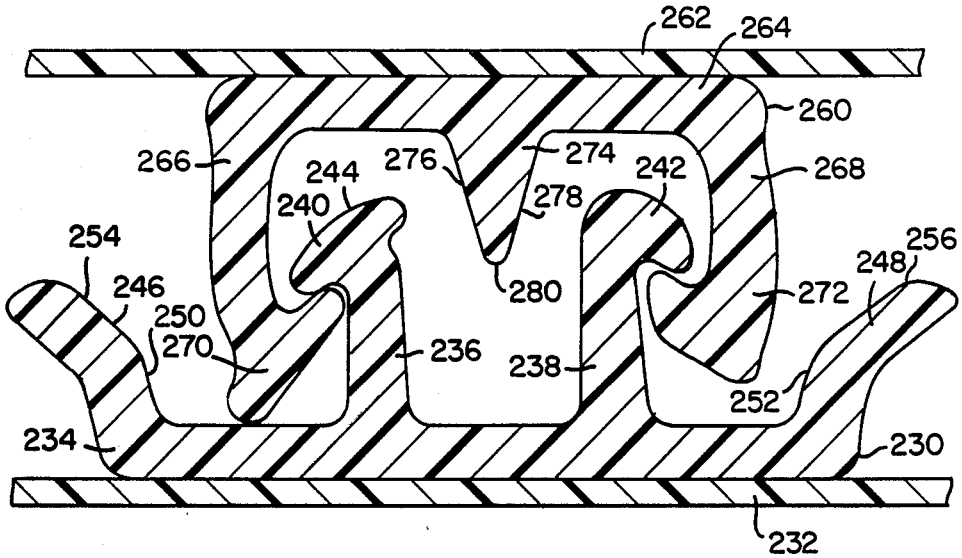
FIG. 15 is a cross-sectional view of another embodiment of the closure fastening device in accordance with the invention in an occluded position having a generally spike-shaped color change enhancement member extending from the base of the female closure element and having guide members on either side of the male closure element.

FIG. 15 is similar to FIG. 6, except the color change enhancement member comprises a generally isosceles triangle-shaped member wherein the sides of the isosceles triangle-shaped color change enhancement member have substantially the same length. As shown in FIG. 15, a male portion 230 is connected to a flange portion 232, and includes a base portion 234, a pair of spaced-apart, parallelly disposed first webs 236 and 238 extending in a generally normal direction from the base portion 232, and male hook portions 240 and 242 extending from webs 236 and 238 and facing away from each other. One of the male hook portions has an inwardly projecting guide surface 244 which generally serves to guide the hook portions for occlusion with the female hook portions of a mating closure element. A second pair of spaced-apart, parallelly displaced second webs 246 and 248 are spaced apart on either outward side of the first spaced apart webs and extend in a generally normal direction at portions 250 and 252 from the base portion 232 with generally outwardly projecting guide surfaces 254 and 256, respectively, to provide guide surfaces for the female closure element. A female element portion 260 is connected to flange portion 262 and includes a base portion 264, a pair of spaced-apart, parallelly disposed webs 266 and 268 extending in a generally normal direction from the base portion 264 and female hook portions 270 and 272 extending from webs 266 and 268, respectively, and facing towards each other and color change enhancement member 274 as a substantially isosceles triangle-shaped member having a first and second faces 276 and 278 extending in a direction from the base portion 264 wherein the length of the first and second faces are substantially of equal length. Closure elements 230 and 260 shown in FIG. 15 may be separately formed and thereafter connected to a film which forms sidewalls (not shown) by the flanges 232 and 262 or they may be integrally formed with such sidewalls (not shown).

Figure 16:
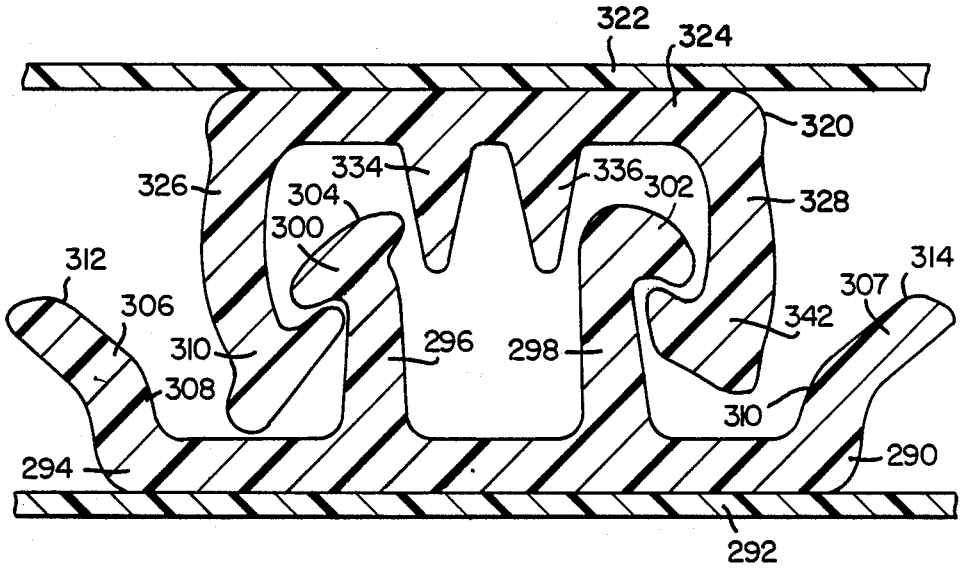
FIG. 16 is a cross-sectional view of another embodiment of the closure fastening device in accordance with the invention in an occluded position having a generally double spike-shaped color change enhancement member extending from the base portion of the female closure element and having guide members on either side of the male closure element.

FIG. 16 is similar to FIG. 15, except the color change enhancement member comprises two substantially isosceles triangle-shaped members wherein the sides of the color change enhancement member are of substantially the same lengths, as measured with respect to where faces said contact the base portion of the closure element. As shown in FIG. 16, a male portion 290 is connected to a flange portion 292 and includes a base portion 294, a pair of spaced-apart, parallelly disposed first webs 296 and 298 extending in a generally normal direction form the base portion 294, and male hook portions 300 and 302 extending from webs 296 and 298 and facing away from each other. One of the male hook portions has an inwardly projecting guide surface 304 which generally serves to guide the hook portions for occlusion with the female hook portions of a mating closure element. A second pair of spaced-apart, parallelly displaced second webs 306 and 307 are spaced apart on either outward side of the first spaced apart webs and extend in a generally normal direction at portions 308 and 310 from the base portion 294 with generally outwardly projecting guide surfaces 312 and 314, respectively, to provide guide surfaces for the female closure element. A female element portion 320 is connected to flange portion 322 and includes a base portion 324, a pair of spaced-apart, parallelly disposed webs 326 and 328 extending in a generally normal direction from the base portion 324 and female hook portions 330 and 332 extending from webs 326 and 328, respectively, and facing towards each other and color change enhancement members 334 and 336 each comprising a substantially triangle-shaped color change enhancement member as described above for FIG. 15.

Figure 17:
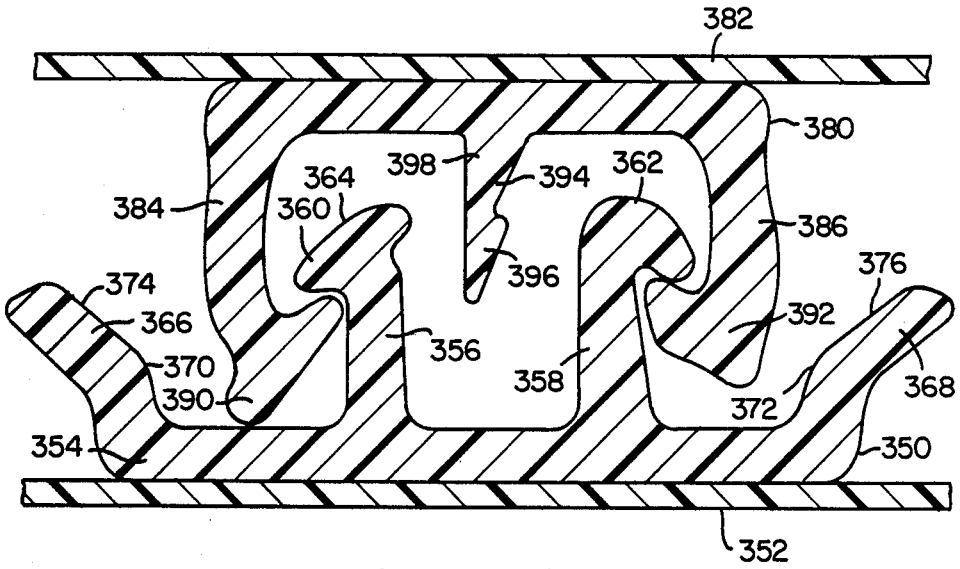
FIG. 17 is a cross-sectional view of another embodiment of the closure fastening device in accordance with the invention in an occluded position having two generally stacked and overlapping triangle-shaped members as the color change enhancement member extending from the base portion of the female closure element and having guide members on either side of the male closure element.

FIG. 17 is similar to FIG. 6, except the color change enhancement member is formed from two triangle-shaped members having an upper triangularshaped member atop a lower triangle-shaped base member. As shown in FIG. 17, a male portion 350 is connected to a flange portion 352 and includes a base portion 354, a pair of spaced-apart, parallelly disposed first webs 356 and 358 extending in a generally normal direction from the base portion 354, and male hook portions 360 and 362 extending from webs 356 and 358 facing away from each other. One of the male hook portions has an inwardly projecting guide surface 364 which generally serves to guide the hook portions for occlusion with the female hook portions of a mating closure element. A second pair of spaced-apart, parallelly displaced second webs 366 and 368 are spaced apart on either outward side of the first spaced apart webs and extend in a generally normal direction at portions 370 and 372 from the base portion 354 with generally outwardly projecting guide surfaces 374 and 376, respectively, to provide guide surfaces for the female closure element. A female element portion 380 is connected to flange portion 382 and includes a base portion 384, a pair of spaced-apart, parallelly disposed webs 386 and 388 extending in a generally normal direction from the base portion 384 and female hook portions 390 and 392 extending from webs 386 and 388, respectively, and facing toward each other and color change enhancement member 394 formed from two right triangle-shaped member having a upper triangle-shaped member 396 atop a lower triangle-shaped base member 398. This form of the color change enhancement member is advantageous in that the light directing effect provided by the color change enhancement member is obtained by us of a smaller mass of thermoplastic material than would be employed if the member was formed by a single triangular mass, e.g., isosceles or right triangle shaped color change enhancement member. This smaller mass is beneficial in the manufacturing closure elements containing the color change enhancement member in that there is a reduction in the mass of thermoplastic material that needs to be cooled after extrusion of the closure element.

Figure 18:
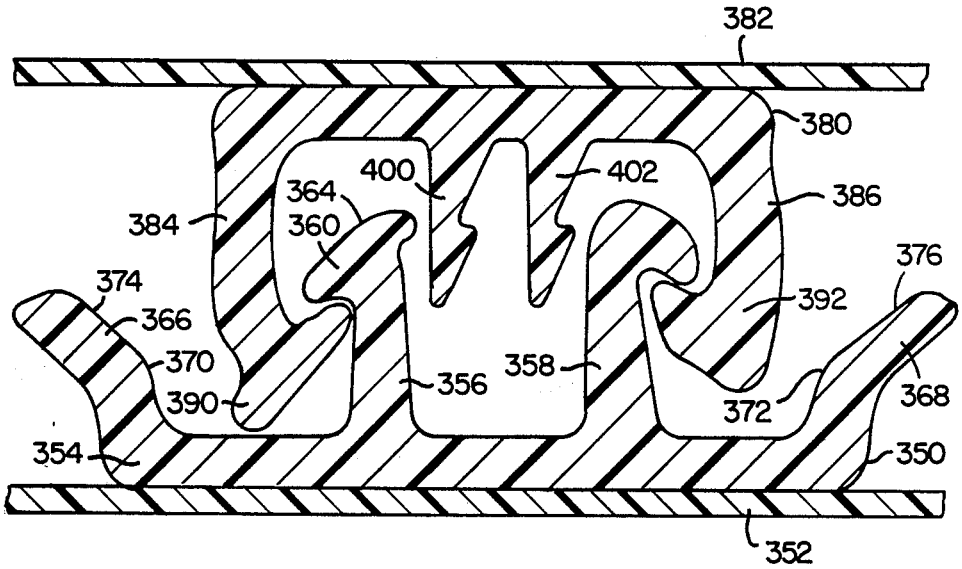
FIG. 18 is similar to FIG. 17, except that the color change enhancement member comprises two of the color change enhancements described in FIG. 17.

FIG. 18 is similar to FIG. 17, except the change enhancement member is formed by two of the color change enhancement members shown and described in FIG. 17. The two color change enhancement members 400 and 402 are shown in FIG. 18 as an integral part of the female closure element disclosed in FIG. 17. The male closure element of FIG. 18 is the same as disclosed and described in FIG. 17.

FIG. 19 show a typical flexible container 410 formed from a thin, plastic film which is folded at bottom portion 412 and heat sealed along the vertical side edges 413 to from a pouch. The sidewalls 414 extend beyond the closure fastening device 415 to provide mouth portions 416 and 418 to simplify the opening of closure fastening device 414.

FIG. 20 is a schematic diagram showing a perpendicular light ray 420 entering face 426 of closure element 422, passing through leg 424 and shown perpendicular to color change enhancement member 428. The color change enhancement member 428 is shown as a generally right triangle-shaped member and has top angle $\phi$ (phi). The light directing properties of color change enhancement member 428 in FIG. 20 show the perpendicular light ray directed to the base of inside closure leg 436 to the point of intersection 432 of the inner face 434 of leg 436 and closure base 430.

FIG. 21 shows the physical dimensions of a male closure element suitable for use with the female closure element shown in FIG. 4. FIG. 6 shows a closure fastening device formed by the female closure element of FIG. 4 and the male closure element of FIG. 21.

I claim:

1. An interlocking closure device including male and female closure elements arranged to be interlocked over a predetermined length, each of said closure elements having different colors for establishing visually the completeness of the occlusion of the closure elements by providing a color different from the closure elements when said closure elements are occluded wherein at least one of the closure elements is translucent, wherein the improvement comprises the introduction of a translucent color change enhancement member, having an index of refraction, in the internal channel of a translucent closure element wherein said color change enhancement member is effective in improving the perceivable color change between said male and female closure elements having different colors and the different color formed by occlusion of the differently colored male and female enclosure elements.

2. The interlocking closure device of claim 1 wherein said color change enhancement member is integrally associated with said male closure element.

3. The interlocking closure device of claim 1 wherein said color change enhancement member is integrally associated with said female closure element.

4. The interlocking closure device of claim 1 wherein the male closure element comprising a U-shaped channel element including a element portion comprising a base portion having a pair of spaced-apart, parallelly disposed webs integrally attached to said base portion and extending therefrom, said webs terminating in hooks, said hooks comprising hook portions facing away from each other an hook projections facing toward each other.

5. The interlocking closure device of claim 1 wherein the female closure element comprises an element portion having a base portion with a pair of spaced-apart, parallelly disposed webs attached to said base portion and spaced-apart to pass over said webs on said male closure element, wherein said webs on said female closure element terminate in hooks extending toward each other to engage on said male closure element.

6. The interlocking closure device of claim 5 wherein said color change enhancement member is integrally associated with said female closure.

7. The interlocking closure device of claim 4 wherein said color change enhancement member is integrally associated with said male closure element.

8. The interlocking closure device of claim 1 wherein the male closure element comprises a U-shaped channel element including a element portion comprising a base portion having a pair of spaced-apart, parallelly disposed webs integrally attached to said base portion and extending therefrom, said webs terminating the hooks, said hooks comprising hook portions facing away from each other and wherein the female closure element comprises a element portion having a base portion with a pair of spaced-apart, parallelly disposed webs attached to said base portion and spaced to pass over said webs on said male closure element, wherein said webs on said female closure element terminate in hooks extending toward each other to engage on said male enclosure element.

9. An interlocking closure device according to claim 8 including male and female closure elements arranged to be interlocking over a predetermined length, each of said closure elements having different colors for establishing visually the completeness of the closure elements by providing a color different from the male and female closure elements when said closure elements are occluded and wherein at least one of said closure elements has guide members integrally formed therewith and spaced adjacent to and apart from said closure element.

10. The interlocking closure device of claim 9 wherein said guide members are integrally formed with said male closure element.

11. The interlocking closure device of claim 10 or claim 13 wherein said guide members are triangularly-shaped.

12. The interlocking closure device of claim 10 or claim 13 wherein said guide members are rectangularly-shaped.

13. The interlocking closure device of claim 9 wherein said guide members are integrally formed with said female closure element.

14. The interlocking closure device of claim 1 or claim 8 or claim 9 wherein the male closure element comprises a U-shaped channel element including a element portion comprising a base portion having a pair of spaced-apart, parallelly disposed webs integrally attached to said base portion and extending therefrom, said webs terminating in hooks, said hooks comprising hook portions facing away from each other said guide members are integrally associated with the male closure element which is opaque and said color change enhancement member is integrally associated with the female closure element which is translucent.

15. The interlocking closure device of claim 14 wherein the female closure element comprises a element portion having a base portion with a pair of spaced-apart, parallelly disposed webs attached to said base portion and spaced to pass over said webs on said male closure element, wherein said webs on said female closure element terminate in hooks extending toward each other to engage on said male closure element.

16. The interlocking closure device of claim 1 wherein said color change enhancement member is characterized as having one face substantially parallel to said pair of spaced-apart, parallelly disposed webs.

17. The interlocking closure device of claim 1 wherein said color change enhancement member has a height less than the height of said spaced-apart, parallelly disposed webs.

18. The interlocking closure device of claim 1 or claim 8 or claim 9 wherein the relationship between the spatial relationship of the translucent closure element and the geometry of the integrally formed color change enhancement member is defined by the relationship:

$$H/\mathrm{Tan}\,(A\sin\,[N\sin p\phi]-\phi)+(H_t-H)\,\mathrm{Tan}\,\phi\leqq D$$

where N is the index of refraction of the material used to make the closure element; H is the height of The incident light ray above the base of the closure element; $H_t$ is the height of the color change enhancement member as measured from the base of the closure element; $\phi$ (phi) is the angle at the top of the color change enhancement member; D is the horizontal distance between the light incident first face of the color change enhancement member and the intersection of the inner face of the inner web of the closure element and the closure base of the closure element.

19. The interlocking closure device of claim 18 wherein the quantity $$H/\mathrm{Tan}\,(A\sin\,[N\sin\phi]-\phi)+(H_t-H)\,\mathrm{Tan}\,\phi$$

is less than D.

20. An interlocking closure device according to claim 1 including male and female closure elements having U-shaped channels arranged to be interlocked over a predetermined length, each of said closure elements having different colors for establishing visually the completeness of the occlusion of the closure elements by providing a color different from the closure elements when said closure elements are occluded, one closure element being opaque and having guide members integrally formed therewith and spaced adjacent to and apart from said webs and the other closure element being translucent.

21. An interlocking closure device according to claim 20 including male and female closure elements arranged to be interlocked over a predetermined length, each of said closure elements having different colors for establishing visually the completeness of the occlusion of the closure elements by providing a color different from the closure elements when said closure elements are occluded; wherein one of the closure elements is translucent and the other closure element is opaque; wherein the male closure element comprises a U-shaped channel element including an element portion comprising a base portion having a pair of spaced-apart, parallelly disposed webs integrally attached to said base portion and extending therefrom, said webs terminating in hooks, said hooks comprising hook portions facing away from each other; wherein the female closure element comprises a U-shaped channel element including an element portion having a base portion with a pair of spaced-apart, parallelly disposed webs attached to said base portion and spaced to pass over said webs on said male closure element, wherein said webs on said female closure element terminate in hooks extending toward each other to engage on said male closure element.

22. The interlocking closure device of claim 1 wherein the width of the closure is greater than about 120 mils.

23. The interlocking closure device of claim 20 or claim 21 wherein the width of the closure is greater than about 120 mils.

24. An interlocking closure device according to claim 1 including male and female closure elements arranged to be interlocked over a predetermined length, each of said closure elements having different colors for establishing visually the completeness of the occlusion of the closure elements by providing a color different from the closure elements when said closure elements are occluded; wherein said female closure element is translucent and said male closure element is opaque; wherein said opaque male closure element comprises a U-shaped channel element including an element portion comprising a base portion having a pair of spaced-apart, parallelly disposed webs integrally attached to said base portion and extending therefrom, said webs terminating in hooks, said hooks comprising hook portions facing away from each other and having guide members integrally formed therewith and spaced adjacent to and apart from said webs; wherein said translucent female closure element comprises a U-shaped channel element including an element portion having a base portion with a pair of spaced-apart, parallelly disposed webs attached to said base portion and spaced to pass over said webs on said male closure element, wherein said webs on said female closure element terminate in hooks extending toward each other to engage on said male enclosure element; with the provision that a translucent color change enhancement member is provided in the U-shaped channel of at least one translucent closure element; and wherein the relationship of the translucent closure element and the color change enhancement member is defined by the relationship:

$$H/\text{Tan}\ (A\sin\ [N\sin\phi]-\phi)+(H_t-H)\text{Tan}\ \phi \leqq D$$

where N is the index of refraction of the material used to make the closure element; H is the height of the incident light ray above the base of the closure element; $H_t$ is the height of the color change enhancement member as measured from the base of the closure element; $\phi$ (phi) is the angle at the top of the color change enhancement member; D is the horizontal distance between the light incident first face of the color change enhancement and the intersection of the inner face of the inner web of the closure element and the closure base of the closure element.

25. The interlocking closure device of claim 21 or claim 22 wherein in the width of the female closure element is between about 120 mils and about 140 mils and the width of the male closure element is between about 170 mils and about 190 mils.

26. The interlocking closure device of claim wherein the width of the female closure element is between about 125 mils and about 135 mils and the width of the male closure element is between about 175 mils and about 185 mils.

27. A container including two sidewalls and an interlocking closure device including male and female closure elements arranged to be interlocked over a predetermined length, each of said closure elements having different colors for establishing visually the completeness of the occlusion of the closure elements by providing a color different from the closure elements when said closure elements are occluded wherein at least one of the closure elements is translucent, wherein the improvement comprises the introduction of a translucent color change enhancement member, having an index of refraction, in the internal channel of a translucent closure element wherein said color change enhancement member is effective in improving the perceivable color change between said male and female closure elements having different colors and the different color formed by occlusion of the differently colored male and female closure elements.

28. A container according to claim 27 including two sidewalls and an interlocking closure fastening device wherein said interlocking closure fastening device including male and female closure elements arranged to be interlocked over a predetermined length, each of said closure elements having different colors for establishing visually the completeness of the occlusion of the closure elements by providing a color different from the closure elements when said closure elements are occluded and wherein one closure element is translucent; said male closure element including an element portion comprising a base portion having a pair of spaced-apart, parallelly disposed webs integrally attached to said base portion and extending therefrom, said webs terminating in hooks comprising hook portions facing away from each other and hook projections facing away from each other; said female closure element including an element portion comprising a base portion having a pair of spaced-apart, parallelly disposed webs integrally attached to said base portion and spaced to pass over said webs on said male closure element and wherein said webs on said female closure element terminate in hooks extending toward each other to engage said hooks on said male closure element.

29. The container of claim 28 wherein said color change enhancement member is characterized as having one face substantially parallel to said pair of spaced-apart, parallelly disposed webs.

30. The container of claim 28 wherein said color change enhancement member has a height less than the height of said spaced-apart, parallelly disposed webs.

31. The container of claim 28 wherein the relationship between the spatial relationship of the translucent closure element and the geometry of the integrally formed color change enhancement member is defined by the relationship:

$$H/\text{Tan}\ (A\sin\ [N\sin\phi]-\phi)+(H_t-H)\text{Tan}\ \phi \leqq D$$

where N is the index of refraction of the material used to make the closure element; H is the height of the incident light ray above the base of the closure element; $H_t$ is the height of the color change enhancement member as measured from the base of the closure element; $\phi$ (phi) is the angle at the top of the color change enhancement member; D is the horizontal distance between the light incident first face of the inner web of the closure element and the closure base of the closure element.

32. The container of claim 31 wherein the quantity $$H/\text{Tan}\ (A\sin\ [N\sin\phi]-\phi)+(H_t-H)\ \text{Tan}\ \phi$$

is less than D.

33. A container according to claim 27 including two sidewalls and an interlocking closure device including male and female closure elements having U-shaped channels arranged to be interlocked over a predetermined length, each of said closure elements having different colors for establishing visually the completeness of the occlusion of the closure elements by providing a color different from the closure elements when said closure elements are occluded, one closure element being opaque and the other closure element being translucent; wherein the improvement comprises the introduction of a refractive translucent color change enhancement member in the internal channel of said translucent closure element.

34. A container according to claim 28 including two sidewalls and an interlocking closure device including male and female closure elements arranged to be interlocking over a predetermined length, each of said closure elements having different colors for establishing visually the completeness of the occlusion of the closure elements by providing a color different from the closure elements when said closure elements are occluded; wherein said male closure element is opaque and said female closure element is translucent; wherein said opaque male closure element comprises a U-shaped channel element including an element portion comprising a base portion having a pair of spaced-apart, parallelly disposed webs integrally attached to said base portions and extending therefrom, said webs terminating in hooks, said hooks comprising hook portions facing away from each other and having guide members integrally formed therewith and spaced adjacent to and apart from said webs; wherein said translucent female closure element comprises a U-shaped channel element including an element portion having a base portion with a pair of spaced-apart, parallelly disposed webs attached to said base portion and spaced to pass over said webs on said male closure element, wherein said webs on said female closure element terminate in hooks extending toward each other to engage on said male closure element; with the provision that a translucent color change enhancement member is in the U-shaped channel of said translucent closure element.

35. The container of claim 34 having an interlocking closure device wherein the width of the closure is greater than about 120 mils.

* * * * *

UNITED STATES PATENT AND TRADEMARK OFFICE

CERTIFICATE OF CORRECTION

PATENT NO. : 4,829,641

DATED : May 16, 1989

INVENTOR(S) : John W. Williams

It is certified that error appears in the above-identified patent and that said Letters Patent is hereby corrected as shown below:

Column 3, line 18: replace word "add" with the word "and".

3, line 24: following "closure" insert --device they may also decrease the discernible color--.

Column 4, line 36: following word "element" insert --is bent--.

Column 11, line 12: following "Y", remove "W".

Column 13, line 38-39: following "same as the" insert --female closure element depicted in FIG. 9, except--.

Column 15, line 46: replace the word "us" with the word "use".

15, line 67: replace the word "from" with the word "form".

Column 16, line 50: replace the word "an" with the word "and".

Column 17, line 3: replace the word "the" with the word "in".

line 11: replace the word "enclosure" with the word "closure".

Column 19, line 43: replace the words "claim, wherein" with "claim 25 wherein".

Signed and Sealed this

Twenty-third Day of April, 1991

*Attest:*

*Attesting Officer*

HARRY F. MANBECK, JR.

*Commissioner of Patents and Trademarks*